United States Patent [19]

Rajasekaran et al.

[11] Patent Number: 4,922,539

[45] Date of Patent: May 1, 1990

[54] METHOD OF ENCODING SPEECH SIGNALS INVOLVING THE EXTRACTION OF SPEECH FORMANT CANDIDATES IN REAL TIME

[75] Inventors: Periagaram K. Rajasekaran; George R. Doddington, both of Richardson, Tex.

[73] Assignee: Texas Instruments Incorporated, Dallas, Tex.

[21] Appl. No.: 302,159

[22] Filed: Jan. 26, 1989

Related U.S. Application Data

[63] Continuation of Ser. No. 743,189, Jun. 10, 1985, abandoned.

[51] Int. Cl.[5] ..... G10L 9/02; G10L 9/04

[52] U.S. Cl. ..... 381/50; 381/41; 381/39; 381/30

[58] Field of Search ..... 364/513.5; 381/29–50

[56] References Cited

U.S. PATENT DOCUMENTS

| | | | |
|---|---|---|---|
| 3,553,372 | 1/1971 | Wright et al. | 381/43 |
| 4,227,177 | 10/1980 | Moshier | 381/45 |
| 4,346,262 | 8/1982 | Willems et al. | 381/50 |
| 4,424,415 | 1/1984 | Lin | 381/39 |
| 4,486,899 | 12/1984 | Fushikida | 381/36 |
| 4,536,886 | 8/1985 | Papamichalis et al. | 381/41 |
| 4,625,286 | 11/1986 | Papamichalis et al. | 364/513.5 |

OTHER PUBLICATIONS

Stark, Introduction to Numerical Methods, MacMillan Publishing Co., NY, 1970, pp. 85–91 and 96–113.

Henrici, Elements of Numerical Analysis, John Wiley & Sons, 1964, pp. 110–115.

Markel et al, Linear Prediction of Speech, Springer-Verlag, Berlin Heidelberg, 1976, pp. 94–95.

*Primary Examiner*—Gary V. Harkcom

*Assistant Examiner*—David D. Knepper

*Attorney, Agent, or Firm*—William E. Hiller; N. Rhys Merrett; Mel Sharp

[57] ABSTRACT

Method of encoding speech signals which is based upon determining the roots of the linear prediction polynomial describing the spectrum of an analog speech signal, wherein the roots are candidates in determining the formants of the speech signal. The method involves the analysis of respective frames of sampled digital speech data using a linear predictive technique to determine a set of reflection coefficients or K-parameters which are then converted into the equivalent predictor coefficients or A-parameters describing a prediction polynomial having a plurality of roots corresponding to the poles of an all-pole filter characterizing the vocal tract. A modified Bairstow technique is then empolyed for factoring out quadratic factors which are then sorted in an ordered arrangement in terms of ascending bandwidths. In performing the modified Bairstow technique, initial estimates of the successive quadratic factors for a current frame of digital speech data are made in sequence, and the prediction polynomial is successively deflated to a reduced order polynomial in determining the respective quadratic factors thereof. The initial estimate of the first quadratic factor is the same as the smallest bandwidth root as determined from the previous frame of digital speech data. These removed quadratic factors or roots are candidates for determining the formants of the speech signal.

8 Claims, 2 Drawing Sheets

METHOD OF ENCODING SPEECH SIGNALS INVOLVING THE EXTRACTION OF SPEECH FORMANT CANDIDATES IN REAL TIME

This is a continuation of application Ser. No. 743,189, filed June 10, 1985, abandoned Mar. 27, 1989.

BACKGROUND OF THE INVENTION

The present invention generally relates to a method of encoding an analog speech signal via speech analysis wherein formant candidates of speech signals are extracted in real time, and more particularly to the real-time root factoring of the linear prediction (LPC) polynomial describing the spectrum of speech signals, wherein the roots are candidates in determining the formants of the vocal tract, and the implementation of the method in a formant-based speech recognition system. Alternatively, the method may be implemented in narrow band speech encoding and in interactive data preparation for a speech synthesis system.

Speech analysis, wherein a frame of sampled speech in digital form is analyzed to extract the information content thereof, has been accomplished by various techniques as a means of reducing the speech data rate required to encode an analog speech signal to more nearly approximate the actual information content in its audible form as heard by a human or by some form of electronic pick-up or receiver device. Speech analysis as generally described hereinabove enables analog speech signals to be placed in a compressed digitized form for storage and transmission as speech signals using a reduced bandwidth. Speech encoding as provided by appropriate speech analysis produces a significant compression in the speech signal as derived from the original analog speech signal which can be utilized to advantage in the general synthesis of speech, in speech recognition and in the transmission of spoken speech.

A technique known as linear predictive coding is commonly employed in the analysis of speech. This technique is based upon the following relation:

$$S_n = -\sum_{k=1}^{p} a_k s_{n-k} + G\sum_{l=0}^{9} b_l u_{n-1},\ b_o = 1 \tag{1}$$

where $s_n$ is a signal considered to be the output of some system with some unknown input $u_n$, with $a_k$, $1 \leqq k \leqq p$, $b_l$, $1 \leqq l \leqq q$, and the gain G are the parameters of the hypothesized system. In equation (1), the "output" $s_n$ is a linear function of past outputs and present and past inputs. Thus, the signal $s_n$ is predictable from linear combinations of past outputs and inputs, whereby the technique is referred to as linear prediction.

By taking the z transform on both sides of equation (1), where H(z) is the transfer function of the system, the following relationship is obtained:

$$H(z) = \frac{S(z)}{U(z)} = G\frac{1 + \sum_{l=1}^{9} b_l z^{-l}}{1 + \sum_{k=1}^{p} a_k z^{-k}}, \tag{2}$$

where $$S(z) = \sum_{n=-\infty}^{\infty} s_n z^{-n} \tag{3}$$

is the z transform of $s_n$, and U(z) is the z transform of $u_n$. In equation (2), H(z) is the general pole-zero model, with the roots of the numerator and denominator polynomials being the zeros and poles of the model, respectively. Linear predictive modeling generally has been accomplished by using a special form of the general pole-zero model of equation (2), namely—the autoregressive or all-pole model, where it is assumed that the signal $s_n$ is a linear combination of past values and some input $u_n$, as in the following relationship:

$$S_n = -\sum_{k=1}^{p} a_k s_{n-k} + G\mu_n \tag{4}$$

where G is a gain factor. The transfer function H(z) in equation (2) now reduces to an all-pole transfer function $$H(z) = \frac{G}{1 + \sum_{k=1}^{p} a_k z^{-k}} \tag{5}$$

Given a particular signal sequence $s_n$, speech analysis according to the all-pole transfer function of equation (5) produces the predictor coefficients $a_k$ and the gain G as speech parameters.

It has long been known that certain speech sounds, most notably the vowels, may be identified and synthesized from a knowledge of the formant frequencies or speech formants in the analysis and perception of speech. See for example, "Automatic Extraction of Formant Frequencies from Continuous Speech"—Flanagan, appearing in *Journal of the Acoustical Society of America,* Vol. 28, pp. 110–118 (Jan. 1956) and "System for Automatic Formant Analysis of Voiced Speech"—Schafer and Rabiner, appearing in *Journal of the Acoustical Society of America,* Vol. 47, pp. 634–648 (Feb. 1970), each of which is hereby incorporated by reference. In this respect, formant frequency data contains more inherent speech intelligence than reflection coefficient data which is the usual form of the speech parameters employed in the linear predictive coding of speech. To this end, efforts have been continuously directed toward the extraction of formant frequencies from continuous speech signals as a basis of speech analysis in which a high degree of speech intelligence is contained within the extracted formant frequencies for use in subsequent speech synthesis, speech recognition or speech data transmission. Heretofore, the extraction of formant frequency data from sampled digital speech data has been recognized as a desirable goal, but efforts to achieve real time determination of speech formants have not been generally regarded as satisfactory.

SUMMARY OF THE INVENTION

The present invention is directed to a method and a speech recognition system implementing same based upon the use of speech formants as a means of providing significant speech intelligence with a reduced speech data rate, wherein the method is concerned with the real time root factoring of the linear prediction (LPC) polynomial of speech signals in establishing candidates (i.e. the roots) for determining the speech formants of the vocal tract. In view of the enhanced speech intelligence as contained in speech formants, such speech analysis products are of significant value in the areas of high performance speech recognition, narrow band speech coding, and interactive data preparation for speech synthesizers.

The method involves the analysis of an analog speech signal by initially placing the analog speech signal in a digital form and sampling the digital speech data to produce successive frames of sampled digital speech data. The frames of sampled digital speech data are respectively analyzed utilizing the linear prediction (LPC) technique to determine a set of speech parameters known as the reflection coefficients, normally called k-parameters, or equivalently the predictor coefficients, normally termed a parameters. These digital linear prediction parameters, as denoted by the predictor coefficients or a-parameters describe a predictor polynomial having a plurality of roots which correspond to the poles of an all-pole filter characterizing the vocal tract. These poles are suitable choices to be considered as candidates for formants. In accordance with the present invention, the determination of the roots of the predictor polynomial corresponding to these poles as formant candidates is achieved in real time and at a reasonable cost as compared to a typical formant tracker technique heretofore employed to determine formants or formant candidates.

The roots of the predictor polynomial are determined by real-time factoring utilizing a modified form of the Bairstow technique. The Bairstow technique is described in the publication, "Elements of Numerical Analysis"—Henrici, published by John Wiley Sons, Inc., New York, N.Y. (1964) on pages 110–115. The Bairstow technique is generally suitable for handling polynomials with real coefficients and complex roots in solving for the roots. The linear prediction polynomial can be operated upon by the Bairstow technique, but typically the Bairstow technique is relatively slow because of the high number of iterations required and tends to lack accuracy in computation for real-time operations.

In accordance with the present invention, the basic Bairstow technique has been modified in important respects to improve the speed of convergence, thereby reducing the number of iterations required to factor out a quadratic polynomial as a root of the linear prediction polynomial. The rate of convergence is affected by the initial estimate of the root locations. By combining the convergence criterion as a bounds on the sum of the absolute values of the step increments of the coefficients of the quadratic factor to be used in the next iteration with an intelligent estimate of the root locations, the average number of iterations required in determining each quadratic factor can be held to a reasonable minimum for real-time operation on programmable signal processors.

With the hereinabove stated modifications in its application, the so-modified Bairstow technique can be employed to perform root factoring on each set of digital prediction parameters representative of a frame of speech data such that a first quadratic factor indicative of a root of the predictor polynomial described by the set of digital linear prediction parameters is determined and then removed from the predictor polynomial leaving a reduced order predictor polynomial. This sequence is repeated by determining a successive quadratic factor of the reduced order predictor polynomial and removing the determined successive quadratic factor from the reduced order predictor polynomial to further reduce the order of the predictor polynomial until a quadratic predictor polynomial remains. In the latter connection, each successive quadratic factor is estimated for the current frame of speech data as based upon the roots as determined from the previous frame of digital speech data in a continuing sequence. Thereafter, the respective estimates of the quadratic factors are sorted in an ordered arrangement of ascending bandwidths, and the respective quadratic factors are removed in a manner based upon the ordered arrangement achieved by the sorting such that the roots are removed in the order of decreasing significance with the more significant roots being removed before the less significant roots.

The method may be implemented in a speech recognition system for identifying a spoken word represented by a digital speech signal, wherein the speech recognition system includes a speech analyzer device for receiving digital speech signals representative of spoken speech comprising one or more words. The speech analyzer device utilizes the linear predictor coding technique to provide a set of speech data parameters from the sampled digital speech signals in the form of reflection coefficients, or k-parameters. The speech recognition system further includes means for converting the reflection coefficients or k-parameters into predictor coefficients, or a-parameters, which describe a predictor polynomial having roots corresponding to the poles of an all-pole filter characterizing the vocal tract. Means are provided for factoring the predictor polynomial in real time for determining the roots of the linear predictor polynomial as candidates for determining the formants of the digital speech signal, thereby implementing the method in accordance with the present invention.

The speech recognition system further includes a memory in which a plurality of reference templates of digital speech data are stored, these reference templates being in terms of speech formants respectively representative of individual words comprising the vocabulary of the word recognition system, with each of the reference templates being defined by a predetermined plurality of formants comprising an acoustic description of an individual word. Data processing means which may suitably take the form of a microprocessor, for example, includes a comparator operably associated with the output of the root factoring means and the memory means, such that each successive speech data frame comprising root parameters as formant candidates is compared with the plurality of reference templates stored in the memory to provide a relative measurement or score for each of the reference templates. The data processor further includes logic circuitry for operating upon the relative scores in determining which one of the plurality of reference templates is the closest match to each respective speech data frame of root parameters in identifying the speech formants definitive of the acoustic speech content of the source of digital speech signals.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, when read in conjunction with the accompanying drawings wherein:

DETAILED DESCRIPTION OF THE INVENTION

The present invention is directed to a method for extracting formant candidates of analog speech signals in real time via root factoring of the linear prediction (LPC) polynomial, and the implementation of the method in a formant-based speech recognition system. In the latter respect, it will be understood that the speech analysis products as produced by the method have relevance to narrow band speech encoding and to interactive data preparation for a speech synthesis system, and also in the transmission of speech data.

Figure 1:
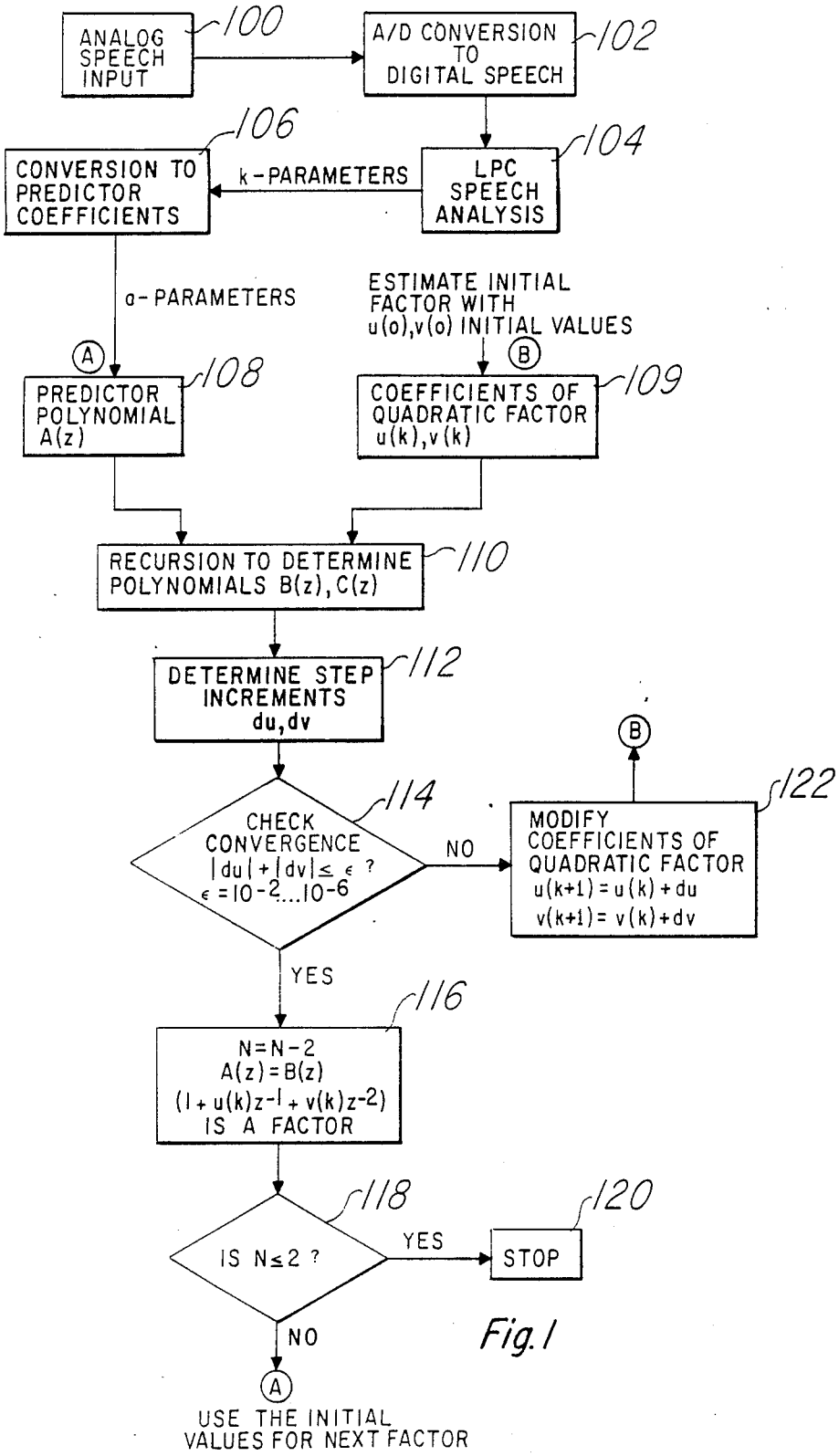
FIG. 1 is a flow chart generally illustrating the method for determining the roots of the linear prediction polynomial of an analog speech signal by real-time factoring as formant candidates in accordance with the present invention.

Referring to the flow chart in FIG. 1 illustrative of the method, initially, an analog speech signal 100 is digitized by suitable means 102 to provide respective frames of sampled digital speech data. These frames of digital speech data are directed to a suitable linear predictive coding speech analyzer 104 to determine a set of speech parameters referred to as reflection coefficients, or k-parameters. These reflection coefficients or k-parameters effectively define the acoustic characteristics of the human vocal tract and may be converted to the equivalent predictor coefficients, or a-parameters as at 106. The predictor coefficients 1, $a_1, \ldots, a_n$ can be produced from the reflection coefficients $k_1, k_2, \ldots, k_n$ through the step-up procedure described in "Linear Prediction of Speech"—J. D. Markel and A. H. Gray, published by Springer-Verlag, Berlin, Heidelberg, N.Y. (1976) on pages 94–95, hereby incorporated by reference. The predictor coefficients, or a-parameters in representing respective frames of speech data describe a predictor polynomial having a plurality of roots which correspond to the poles of an all-pole filter characterizing the vocal tract. The initial speech analysis using linear predictive coding techniques to obtain the reflection coefficients or k-parameters and the conversion of the k-parameters to predictor coefficients or a-parameters may be accomplished by a suitable speech analysis device for this purpose, such as the signal processor integrated circuit known as the TMS 320 chip available from Texas Instruments Incorporated of Dallas, Tex. Having determined the predictor coefficients or a-parameters, the all-pole model is now determined in accordance with equation (5) from which an inverse predictor polynomial is provided as at 108 in accordance with the following relationship:

$$A(z) = H \sum_{k=1}^{p} a_k z^{-k} \tag{6}$$

In accordance with the present invention, a modified version of the Bairstow technique is employed for factoring the polynomial with real coefficients into a set of quadratic polynomials, for which the roots can be obtained by simple analysis. In this respect, the Bairstow technique may be generally described as a factoring technique which operates by determining a quadratic factor of the polynomial (by a Newton-Raphson type iterative scheme), removing it by synthetic division (called the deflation process), and determining the next quadratic factor from the reduced order polynomial resulting from the preceding synthetic division. Successive determinations of quadratic factors and deflation are carried out until the deflation results in a quadratic polynomial. The Bairstow factoring technique offers a relatively slow rate of convergence because of the number of iterations required to effect convergence and is subject to unstable accuracy from using finite precision computations to obtain the factoring results. Thus, the Bairstow technique as conventionally employed as a root solving technique cannot be reliably utilized in the real-time determination of the roots corresponding to the poles of an all-pole filter characterizing the vocal tract.

In accordance with the present invention, the choice of convergence criterion typically employed with the Bairstow factoring technique is modified by specifying bounds on the sum of the absolute values of the step increments of the coefficients of the quadratic factor to be used in the next iteration. If this sum is smaller than the bound (a very small number), the new location of the root pairs will be very close to the previous location. This modified convergence criterion is simpler to implement and does not require the division operations associated with the ratio type convergence criterion typically employed with the Bairstow factoring technique (i.e. as specified as a bound on the ratios of the step increments to the coefficients of the quadratic). Generally, a bound lying within a range of values $10^{-2}$ to $10^{-6}$ may be used. Thus, where A(z) is the linear prediction polynomial given by the expression:

$$A(z) = 1 + a_1 z^{-1} + \ldots + a_N z^{-N} \tag{7}$$

$a_N z^{-N}$ would become $a_{10} z^{-10}$ (where 10 predictor coefficients are employed)

The desired goal is to decompose the foregoing linear prediction polynomial by factoring in accordance with $$A(z) = \prod_{i=1}^{N/2} [1 + f(1,i)\, z^{-1} + f(2,i)\, z^{-2}] \tag{8}$$

For speech applications, the coefficients in the above two polynomials of equations (7) and (8) are real.

Next, an intelligent initial estimate of the root locations is made. In this respect, generally the roots of the predictor polynomial are complex, and lie at a radial distance of approximately unity from the origin in the complex z-plane. This fact can be used as a basis for initializing the estimation of the root locations distributed uniformly on the unit circle. By relying upon the fact that the roots of the predictor polynomials change gradually over successive frames of speech, an improved estimate of the root locations can be achieved by making the initial estimations for the root locations of the current frame of speech data being the same as the roots determined from the previous frame of speech data. Further improvements in the estimation of the root locations are achieved by sorting the respective estimates in ascending order of bandwidth while utilizing the modified version of the Bairstow technique as described herein. This root ordering causes computationally more sensitive roots to be removed first, thereby generally insuring reasonable accuracy of the deflation process and the subsequent factoring, and perceptually less significant roots to be removed at later stages of the computation where the cumulative finite precision errors are at a maximum.

Thus, an initial factor is estimated as $(1+f(1,1)z^{-1}+f(2,1)z^{-2})$ where the coefficients f(1,1) and f(2,1) at the first iteration are estimated as equal to u(0) and v(0), respectively, as at B and 109.

Thereafter, the first quadratic factor is removed by synthetic division referred to as the deflation process to produce a reduced order polynomial B(z), as follows:

$$\frac{A(z)}{1 + f(1,1)\,z^{-1} + f(2,1)\,z^{-2}} = B(z) \tag{9}$$

Sets of coefficients [b(i)], i=0, 1, . . . N, and [c(i)], i=0, 1, . . . N−1 are then generated as at 110 with the following recursions as indicated in the relationships:

$$b(i)=a(i)-u(k)b(i-1)-v(k)b(i-2), \text{ and} \tag{10}$$

$$c(i)=b(i)-u(k)c(i-1)-v(k)c(i-2) \tag{11}$$

with the initial conditions $$a(0)=1$$

$$b(-1)=b(-2)=0$$

$$c(-1)=c(-2)=0$$

where u(k) and v(k) are the coefficient values of the quadratic at the k-th iteration. The coefficients [b(i)] correspond to the deflated polynomial B(z) as given by equation (9).

Given the coefficients [b(i)] and [c(i)], and the current values u(k) and v(k) of the quadratic, the correction increments f(1,1) or du and f(2,1) or dv can be determined as at 112 as required for the (k+1)st iteration.

$$DET=(c(N-2)**2-c(N-1)*c(N-3)) \tag{12}$$

The correction increments du and dv are now determined as follows:

$$du=[b(N)*c(N-3)-b(N-1)*c(N-2)]/DET \tag{13}$$

$$dv=[b(N-1)*c(N-1)-b(N)*c(N-2)]/DET \tag{14}$$

A check for the convergence at this stage is then conducted as at 114. Heretofore, typically, the convergence check has been made by determining the ratios du/u(k) and dv/v(k) and comparing these ratios to a very small number, such as in accordance with the following relationship:

$$\left|\frac{du}{u}\right|\left|\frac{dv}{v}\right| < \begin{cases} 10^{-2} - 10^{-6} \\ \rightarrow \text{converged} \end{cases}$$

This technique involves time-consuming division operations of a nature generally unsatisfactory in speech applications.

In accordance with the present invention, a modified convergence-checking technique has been adopted which is based upon the recognition that all of the zeros of the LPC polynomial of speech are located inside the unit circle in the z-plane. Thus, the modified convergence check 114 involves a determination as to whether the sum of the absolute values of du and dv is less than a prescribed small number, as in the following relationship:

$$[|du| + |dv|] \begin{cases} \overset{\text{conv}}{\leqq} \\ > \end{cases} \begin{cases} \text{pre-determined} \\ 10^{-2} - 10^{-6} \end{cases} \tag{15}$$

no conv →iterate one more time

It will be understood that the process of determining respective quadratic factors has converged if the relationship for convergence expressed in equation (15) has occurred, such that the current values of u(k) and v(k) correspond to a quadratic factor of the polynomial A(z).

The process of determining the next quadratic factor then begins by dividing the polynomial A(z) by the quadratic factor as determined to produce a new polynomial A′(z) of order N−2 as at 116. (This corresponds to equation (9) where the new reduced order polynomial is represented as B(z).) The coefficients of the new polynomial A′(z) are the same as the first N−2 coefficients of the sets of coefficients [b(i)] as previously identified. This process of determining the next quadratic factor is repeated to identify a succession of quadratic factors until only a quadratic polynomial remains as at 118, whereupon the process stops as at 120 for that speech frame. Where additional quadratic factors are present, the next quadratic factor of the polynomial A(z) is then determined by repeating the sequence of steps beginning at A practiced with respect to the polynomial A(z) as at 108, wherein the new reduced order polynomial A′(z) is substituted for the polynomial A(z).

If the convergence-check relationship as set forth in equation (15) has not occurred at 114, the coefficients of the quadratic factor are modified as at 122, as follows:

$$u(k+1)=u(k)+du \tag{16}$$

$$v(K+1)=v(k)+dv \tag{17}$$

Then, the (K+1)st iteration is performed with the modified coefficients of the quadratic factor beginning at B 109 in accordance with the sets of coefficients [b(i)] and [c(i)]. The sequence of steps is then repeated until a quadratic factor is determined in the resulting deflated polynomial A′(z). As earlier indicated, the process continues as at Ⓑ 109 with an intelligent initial estimate of the root locations for the next speech frame (now the current speech frame) which can be the same as the roots determined from the previous frame of speech data, with the respective estimates being sorted in order of ascending bandwidths.

By employing the modified Bairstow technique as described herein with respect to determining the roots of the linear prediction (LPC) polynomial of a speech signal using a finite precision programmable digital signal processor, such as the TMS 320 integrated circuit chip available from Texas Instruments Incorporated of Dallas, Tex., it has been determined that real-time root factoring can be accomplished with a limited amount of buffering via appropriate memory registers with respct to the input speech data to prevent the loss of such speech data. Buffering of the input speech data is required in instances where frames of speech data are present requiring execution times longer than the average time for factoring the roots from the linear prediction polynomial defined by the frame of speech data.

Figure 2:
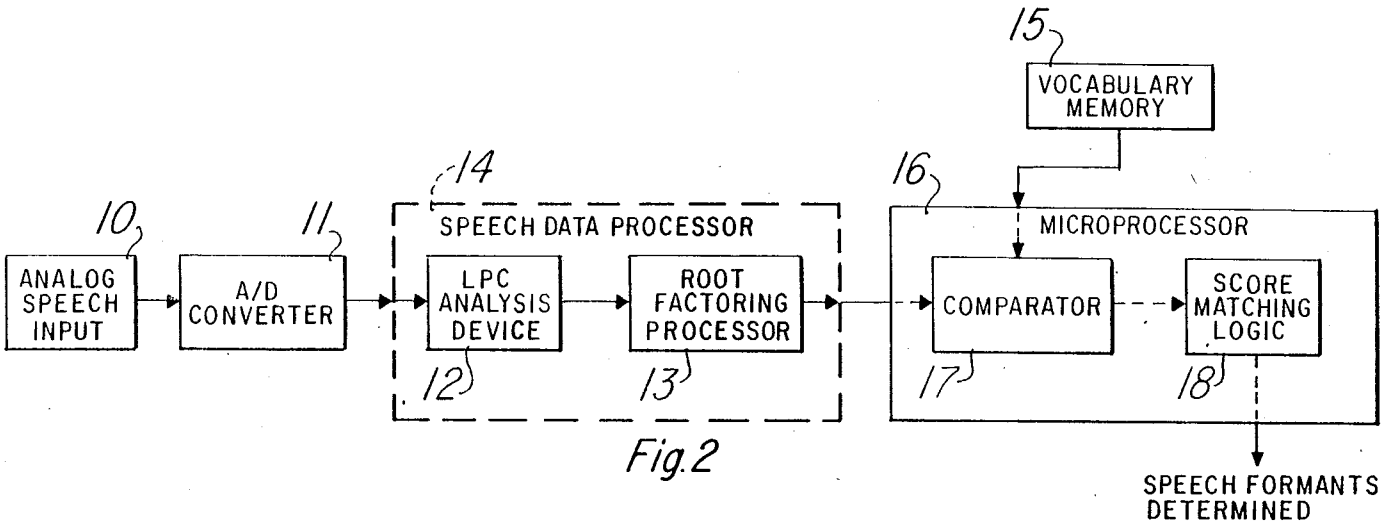
FIG. 2 is a functional block diagram of a word recognition system as constructed in accordance with the present invention in implementing the method illustrated in FIG. 1.

The technique of determining speech formant candidates by real-time factoring of the roots of the linear prediction polynomial derived from digital speech data representative of an analog speech signal may be implemented in the speech recognition system illustrated in FIG. 2. To this end, an analog speech signal input 10 which may be derived from any suitable source, such as a telephone, a radio or a microphone, for example, is digitized in an appropriate manner, such as by an analog-to-digital converter 11 to form a source of digital speech which is input to a speech analysis device 12. The speech analysis device 12 employs linear predictive coding for speech analysis to provide a plurality of k-parameters known as reflection coefficients. Typically, a complete set of such k-parameters may comprise ten reflection coefficients $k_1$–$k_{10}$ which selectively simulate the acoustic characteristics of the human vocal tract. Each successive frame of digital speech data in the form of linear predictive coding parameters as provided from the output of the speech analysis device 12 is input to a root-factoring speech data processor 13, such as the TMS 320 previously referred to, for real-time root factoring of the linear predictor polynomial in the manner herein described so as to output root parameters as speech formant candidates in successive frames of speech data. The linear prediction speech analysis device 12 and the root-factoring speech data processor 13 may be suitably combined in a unitary speech data processor 14 capable of performing both procedures. In this respect, the TMS 320 has such a capability, for example. The speech recognition system further includes a vocabulary memory 15, such as a read-only-memory (i.e. ROM), in which a plurality of reference templates of digital speech data in terms of speech formants is provided. The respective reference templates are representative of individual words or parts of words and comprise the vocabulary of the speech recognition system. In this respect, a predetermined plurality of formants are included in each of the reference templates so as to be representative of different acoustic descriptions of individual words. A second data processor 16 which may take the form of a microprocessor having a comparator 17 is operably associated with the output of the first data processor 13 performing the root factoring and with the vocabulary memory 15. The comparator 17 of the microprocessor 16 acts upon each successive speech data frame comprising root parameters as formant candidates by comparing the speech data frame with each of the plurality of reference templates as stored in the vocabulary memory 15 to obtain a relative measurement or score as to the relative identity between the respective speech data frame and each of the plurality of reference templates. The microprocessor 16 further includes logic circuitry 18 which evaluates the relative scores as provided by the comparison between the speech data frame and each of the plurality of reference templates so as to determine the closest match to each respective speech data frame of root parameters, thereby identifying one of the plurality of reference templates which is representative of the actual acoustic speech content of the source of digital speech signals as represented by the speech data frame. The reference template which is the closest match to the speech data frame of root parameters contains the actual speech formants as derived from the extracted formant candidates or roots.

The present invention therefore enables real-time root factoring of the linear predictive polynomial of speech signals using a finite precision programmable processor such as the TMS 320 digital signal processing chip available from Texas Instruments Incorporated of Dallas, Tex. The computational requirements imposed by the technique of root factoring as set forth herein in accordance with the present invention are relatively light, requiring only a limited amount of buffering of input speech data to achieve real-time operation. Thus, the invention provides for the designation of speech formant candidates in real time and at a practical cost for provision to a formant tracker or to a speech recognition system wherein the true speech formants are determined from such candidates.

Although preferred embodiments of the invention have been specifically described, it will be understood that the invention is to be limited only by the appended claims, since variations and modifications of the preferred embodiments will become apparent to persons skilled in the art upon reference to the description of the invention herein. Therefore, it is contemplated that the appended claims will cover any such modifications or embodiments that fall within the true scope of the invention.

What is claimed is:

1. A method of encoding an analog speech signal via speech analysis, said method comprising the steps of:

providing an analog speech signal;

digitizing the analog speech signal to provide a plurality of samples of digital speech data;

arranging the plurality of digital speech data samples in successive frames of digital speech data, each frame containing a plurality of digital speech data samples;

analyzing the frames of digital speech data utilizing a linear predictive coding technique to determine a set of linear predictive coding speech parameters for each frame defining the linear prediction polynomial;

subjecting respective frames of linear predictive coding speech parameters defining the linear prediction polynomial to a root factoring procedure involving initially determining a first quadratic factor indicative of a root of the prediction polynomial for a first current frame of digital speech data by deflating the prediction polynomial to a reduced order polynomial, successively determining the next quadratic factor for the first current frame of digital speech data in a continuing sequence until the prediction polynomial is reduced to a remaining quadratic polynomial factor, sorting the respective quadratic factors in the order of increasing bandwidth of the roots indicated thereby, and extracting roots based upon the sequence of the order of increasing bandwidth such that roots are removed in the order of decreasing significance as speech formant candidates;

continuing the root factoring procedure with subsequent successive frames of digital speech data by estimating a first quadratic factor indicative of a root of the prediction polynomial for the next successive current frame of digital speech data based upon the roots as extracted from the previous frame of digital speech data, determining the first quadratic factor beginning with the estimation thereof by deflating the prediction polynomial to a reduced order polynomial, successively determining the next quadratic factor for said next successive current frame of digital speech data by initially estimating said next quadratic factor for said next successive current frame of digital speech data based upon the roots as extracted from the previous frame of digital speech data, and thereafter determining the next quadratic factor for said next successive current frame of digital speech data beginning with the estimation thereof in a continuing sequence until the prediction polynomial is reduced to a remaining quadratic polynomial factor, sorting the respective quadratic factors for said next successive current frame of digital speech data in the order of increasing bandwidth of the roots indicated thereby, and extracting roots for said next successive current frame of digital speech data based upon the sequence of the order of increasing bandwidth;

utilizing the extracted roots as speech formant candidates; and determining the speech formants from the extracted roots as speech formant condidates in representing the analog speech signal as a compressed encoded form of digital speech signals.

2. A method as set forth in claim 1, further including storing or transmitting the speech formants as determined from the speech formant candidates provided by the extracted roots as digital speech signals representative of the analog speech signal.

3. A method of encoding an analog speech signal via speech analysis, said method comprising the steps of:

providing an analog speech signal;

digitizing the analog speech signal to provide a plurality of samples of digital speech data;

arranging the plurality of digital speech data samples in successive frames of digital speech data, each frame containing a plurality of digital speech data samples;

analyzing the frames of digital speech data utilizing a linear predictive coding technique to determine a set of linear predictive coding speech parameters as digital speech data representative of reflection coefficients for each frame;

converting said digital speech data representative of reflection coefficients for each frame to digital speech data representative of predictor coefficients;

defining a linear prediction polynomial from each frame of digital speech data representative of predictor coefficients;

subjecting respective frames of digital speech data representative of predictor coefficients defining the linear prediction polynomial to a root factoring procedure involving initially determining a first quadratic factor indicative of a root of the prediction polynomial for a first current frame of digital speech data by deflating the prediction polynomial to a reduced order polynomial, successively determining the next quadratic factor for the first current frame of digital speech data in a continuing sequence unitl the prediction polynomial is reduced to a remaining quadratic polynomial factor, sorting the respective quadratic factors in the order of increasing bandwidth of the roots indicated thereby, and extracting roots based upon the sequence of the order of increasing bandwidth such that roots are removed in the order of decreasing significance as speech formant candidates;

continuing the root factoring procedure with subsequent successive frames of digital speech data by estimating a first quadratic factor indicative of a root of the prediction polynomial for the next successive current frame of digital speech data based upon the roots as extracted from the previous frame of digital speech data, determining the first quadratic factor beginning with the estimation thereof by deflating the prediction polynomial to a reduced order polynomial, successively determining the next quadratic factor for said next successive current frame of digital speech data by initially estimating said next quadratic factor for said next successive current frame of digital speech data based upon the roots as extracted from the previous frame of digital speech data, and thereafter determining the next quadratic factor for said next successive current frame of digital speech data beginning with the estimation thereof in a continuing sequence until the prediction polynomial is reduced to a remaining quadratic polynomial factor, sorting the respective quadratic factors for said next successive current frame of digital speech data in the order of increasing bandwidth of the roots indicated thereby, and extracting roots for said next successive current frame of digital speech data based upon the sequence of the order of increasing bandwidth;

utilizing the extracted roots as speech formant candidates; and determining the speech formants from the extracted roots as speech formant candidates in representing the analog speech signal as a compressed encoded form of digital speech signals.

4. A method as set forth in claim 3, further including storing or transmitting the speech formants as determined from the speech formant candidates provided by the extracted roots as digital speech signals representative of the analog speech signal.

5. A method as set forth in claim 3, wherein the root of the first quadratic factor for the current frame of digital speech data is estimated as the same as the smallest bandwidth root as determined from the previous frame of digital speech data.

6. A method as set forth in claim 5, wherein the determination of the first quadratic factor and respective successive quadratic factors of the prediction polynomial includes deflating the prediction polynomial to a reduced order polynomial by successively iterating the prediction polynomial with coefficient values corresponding to the deflated polynomial being progressively incremented in magnitude for each iteration until convergence occurs when the coefficient values correspond to a quadratic factor of the prediction polynomial.

7. A method as set forth in claim 6, further including checking for convergence as a bounds on the sum of the absolute values of the step increments du and dv of the coefficient values of the quadratic factor in accordance with the following relationship:

$$|du| + |dv| \leqq \epsilon, \text{ where}$$

$\epsilon$ is a constant magnitude lying in the range of $10^{-2}$ to $10^{-6}$.

8. A method as set forth in claim 5, wherein the root of the next quadratic factor after said first quadratic factor for the current frame of digital speech data is estimated as the same as the second smallest bandwidth root as determined from the previous frame of digital speech data.

* * * * *